United States Patent [19]

Fernandez

[11] 3,998,067

[45] Dec. 21, 1976

[54] CONTINUOUS SHORING MACHINES FOR TUNNEL CONSTRUCTION

[75] Inventor: D. Julio Antonio Garcia Fernandez, Madrid, Spain

[73] Assignee: Mackina Westfalia, S.A. & Corsan, Madrid, Spain

[22] Filed: Mar. 26, 1975

[21] Appl. No.: 562,127

[30] Foreign Application Priority Data

Mar. 28, 1974 Spain ..... 424721

[52] U.S. Cl. ..... 61/85; 299/31

[51] Int. Cl.[2] ..... E01G 3/04

[58] Field of Search ..... 61/85, 84, 45, 42; 299/31

[56] References Cited

UNITED STATES PATENTS

| | | | |
|---|---|---|---|
| 3,581,507 | 6/1971 | Stevens | 61/85 |
| 3,870,368 | 3/1975 | Winberg | 61/85 |

FOREIGN PATENTS OR APPLICATIONS

| | | | |
|---|---|---|---|
| 42,305 | 11/1965 | Germany | 61/85 |

*Primary Examiner*—Jacob Shapiro
*Attorney, Agent, or Firm*—Fleit & Jacobson

[57] ABSTRACT

An improved shoring machine for tunnel construction in which a load-bearing structure provided with shores for shaping and shoring up the tunnel is supported on skids with the structure supported on the skids and shores, the skids being guided for vertical and horizontal movement and having wings, portions of which have matching holes arranged in overlapping relationship together with a beam having a bottom surface located in the space between each pair of skids and provided with a plurality of teeth arranged to be accommodated within said holes, the teeth being long enough to serve an anchoring elements on the tunnel floor when projecting through the holes to facilitate the advance of the frame and to permit changes in the direction of movement of the frame to the right or left, the beam being pivoted at its front end on one pair of skids about a transverse axis and the beam having a back end connected through a hydraulic cylinder to the load-bearing structure with the hydraulic cylinder being arranged to retract said teeth upon raising of said beam.

5 Claims, 10 Drawing Figures

FIG. 2
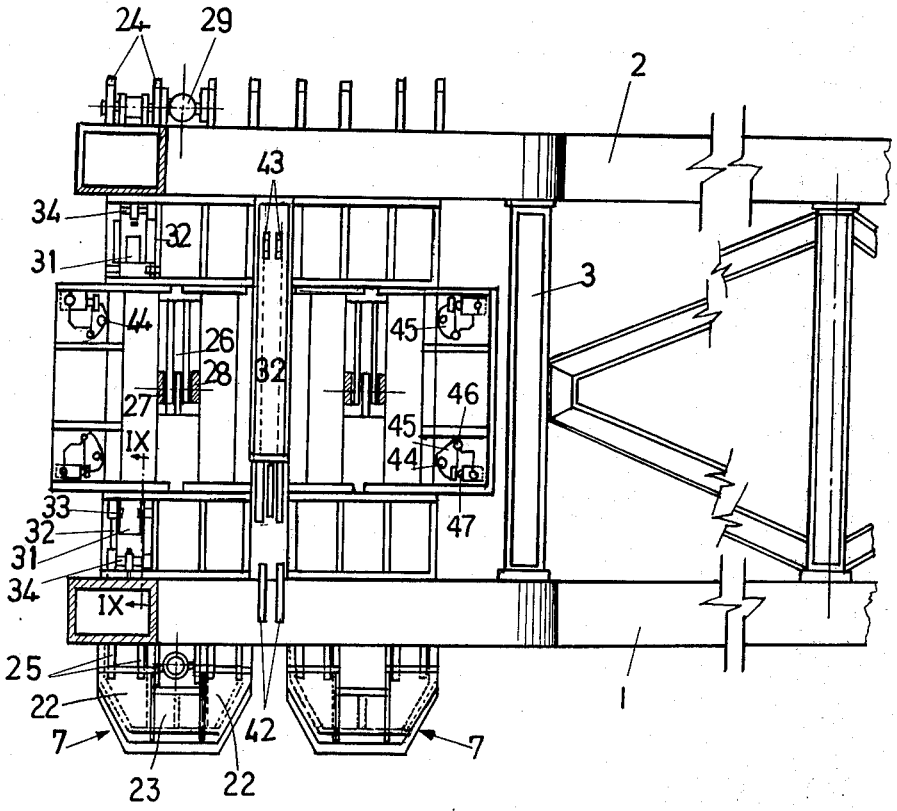
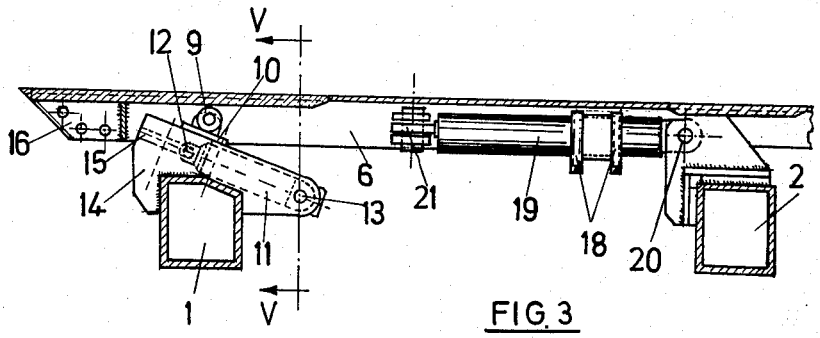
FIG. 3

FIG.4
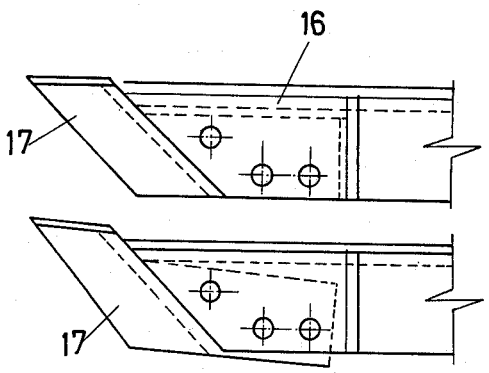
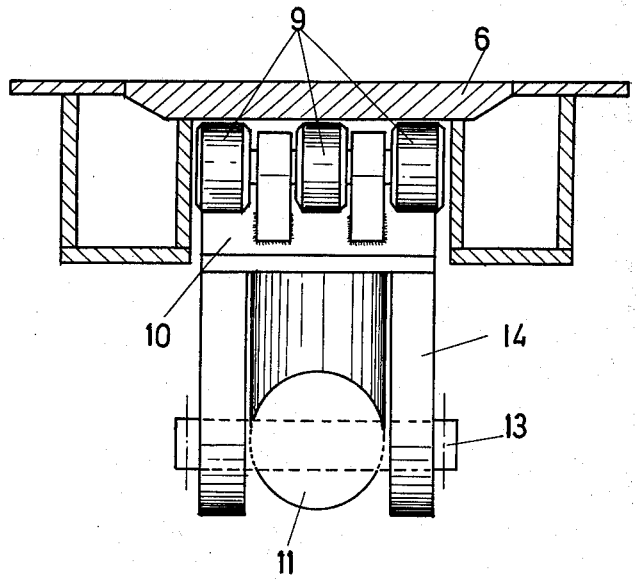
FIG.5

CONTINUOUS SHORING MACHINES FOR TUNNEL CONSTRUCTION

BACKGROUND OF THE INVENTION

The present invention concerns improvements in continuous shoring machines for tunneling of the type consisting of a load-bearing structure which rests on supporting skids and on which are mounted shoring members for shaping and propping up the tunnel surface.

Until now, the methods used in tunneling have been based on partial excavation of the tunnel portion under construction and immediate shoring up of the said excavated part. Then, once the section worked on is safe, repeating the process until the entire section is excavated and afterwards proceeding to line it with concrete.

These methods, recognized up to now, have the great disadvantage of not being up to the technological level which the other operations, e.g., the excavation and transport of the muck, placing forms, concreting, etc., have reached. For this reason, various procedures have been developed for mechanized excavation which accelerate the work, performing it at high speed and low cost. However, these systems are hindered by the later manual shoring in stages, carried out by outdated methods, impeding the execution of the project in a continuous manner, as if the excavation were not mechanized.

The object of the present invention is to develop a machine which avoids the previous drawbacks, which provides a method of continuous shoring by a special machine across the entire section of the tunnel at the same time, the machine having, moreover, the necessary means for advancing as the work proceeds, as well as the arrangements and mechanisms necessary for controlling this advance and positioning so that at every instant the entire rig is oriented and in perfect contact with the tunnel surface, developing the pressures required for the best progress of its work.

As has been pointed out, the machine consists of a load-bearing structure resting on supporting skids and on which are mounted shores for shaping and shoring up the tunnel surface.

The sturdy frame is formed by two arches, preferably parallel, one in front and one behind, separated by a space sufficient for the requirements of fitting in the various systems and elements of the machine. The arches are firmly connected to one another by suitable bracing members and a platform base, forming a rigid overall structure, the section of which is variable in accordance with the dimensions of the tunnel.

The structure described is that which absorbs the load of supporting the tunnel walls and roof and on which are mounted the other elements.

The rig is furnished with suitable hydraulic circuits with corresponding cylinders for moving the machine forward.

In accordance with the invention, the rig is provided with elastic supports connecting the sturdy frame to the skids and shores, as well as means of guiding the skids vertically and horizontally.

The elastic supports and the means of guiding the skids help to orient the machine in plane and elevation, avoiding an excessive or uncontrolled displacement between the skids and the frame and maintaining the relative positions of the two. That is, the rig is given a firm footing on the tunnel floor, passing over obstacles on it, the machine being aided in its sliding and orientation at all times in following the prescribed course.

For their part, the elastic supports of the shores permit obtaining the following effects.

a. Varying the machine's section with consequent variation of the excavated and shored section, as required;

b. Maintaining the shores in contact with the surfaces to be propped up by means of their controllable position;

c. Guiding the machine in plan and elevation, enlarging the sections according to their orientation and producing a set of pressures for displacing the machine along the assigned course;

d. Increasing the friction forces between the shores and the tunnel surface, with the result that the hydraulic cylinders of each of the shores cause the frame to advance when they are actuated in the direction opposite to their own advancement;

e. Suitably distributing the tensions produced in the shores and equalizing the load transmitted to the two arches.

The supports of the shores are elastic, gradual and variable, and the basic idea of their arrangement is to make the forward arch controllable in order always to keep the shores in contact with the tunnel surface.

The elastic supports connecting the frame to the skids consist of freely rotating rollers with horizontal axes which rest on top of the skids and are each mounted between two lugs pivoted at corresponding ends on; the machine, while at their opposite ends, the said load-bearing frame is supported by the intermediary of a hydraulic cylinder actuated by its corresponding circuit with nitrogen accumulators and corresponding oil reservoirs. Each skid can carry four rollers of this type, two in front and two in back, the various hydraulic circuits being able to cooperate for producing the combinations necessary to compensate for the irregularity of the tunnel floor on either side.

This whole arrangement permits varying the inclination of the skids in a vertical plane with respect to the frame, and with it the height of the frame at its front or back, facilitating the orientation of the machine.

Identical elastic supports but having the rollers turning about vertical axes, are disposed at the sides of the skids for guidance in a horizontal direction, by being able to vary the inclination of the skids in a horizontal plane with respect to the frame and thus changing the orientation of the rig.

For their part, the elastic supports which connect the frame to the shores consist of a freely rotating roller on which the shore rests at its front end. This roller is mounted on an independent support on which is pivoted the front end of a hydraulic cylinder, the back end of which is anchored by means of a corresponding pivot on the frame. This axis of articulation between the support and the cylinder is mounted between two lugs attached to the forward arch of the frame, with the ability to slide within two opposing slots in the said lugs, slots which define an upwardly inclined plane along which the axis of articulation slides under the action of the corresponding cylinder.

This construction permits the end section of the shore to be forced outward so as to exert a controlled pressure against the tunnel surface, and which facilitates, moreover, the forward movement of the structure.

The shores are actuated by means of an impulse cylinder mounted in collars attached to the shores, these cylinders articulating at their back end on lugs attached to the rear arch of the frame, which at their forward end are articulated on the shore.

The variations in the machine's section are obtained on the one hand by means of the above described elastic suspension and, on the other, by positioning the heads of the shores.

The means for guiding the skids in the vertical direction consist of a beam inside each skid composed of two pieces of equal length, mutually articulated about a horizontal axis. This axis is mounted between two lugs attached to the frame. Further, the two parts of the beam pivot at their free ends of the forward and rear arches of the frame by means of pivoting hydraulic cylinders. Each part of the beam is also provided with an upper, freely rotating roller on which the skid rests in such a way that on the one hand, the load-bearing structure rests on the skids by way of the rollers which form the elastic supports and, on the other hand, each skid rests on the guide beam by way of the upper rollers mounted on the beam.

Inside each skid there slides, in addition, two hydraulic jacks connected to the skid at one end and to the frame at the other, their purpose being the displacement of the rig in conjunction with the impulse cylinders of the shores.

With the described construction, the skids are always held in the same plane, avoiding excessive or uncontrolled displacement with respect to the frame and maintaining their relative positions.

Each pair of skids is connected together by an intervening anchoring beam. For this purpose, each pair of skids has longitudinal wings projecting from the bottoms of their opposed faces shaped so that they overlap over a portion provided with overlapping holes through which project teeth protruding from the bottom surface of the anchoring beam. The anchoring beam is articulated at its front end to the skid pair in which it is located by means of a transverse axis of rotation while on the top of its back end, it is connected to the load-bearing frame by way of a hydraulic cylinder. The anchoring teeth are long enough to dig into the tunnel floor and prevent the skids from sliding backwards when their advancing cylinders are actuated. During the advance of the skids, the cylinder of the anchoring beam is actuated so as to raise it and retract the teeth so that they do not impede the advance. By anchoring the teeth of the beams on one side of the frame and raising the beams on the other side, the direction of motion of the machine can be turned to the right or left.

BRIEF DESCRIPTION OF THE DRAWINGS

To make the construction, characteristics and operation of the machine of the invention easier to understand, there follows a more detailed description of it with reference to the attached drawings in which is shown a form of embodiment by way of a non-restrictive example, and in which;

FIG. 2 is a partial, half plan view of the rig;

FIG. 3 is a longitudinal section of a shore;

FIG. 4 is a side view of the head of the shore;

FIG. 5 is a section along the line V—V of FIG. 3;

DESCRIPTION OF THE PREFERRED EMBODIMENT

Figure 1:
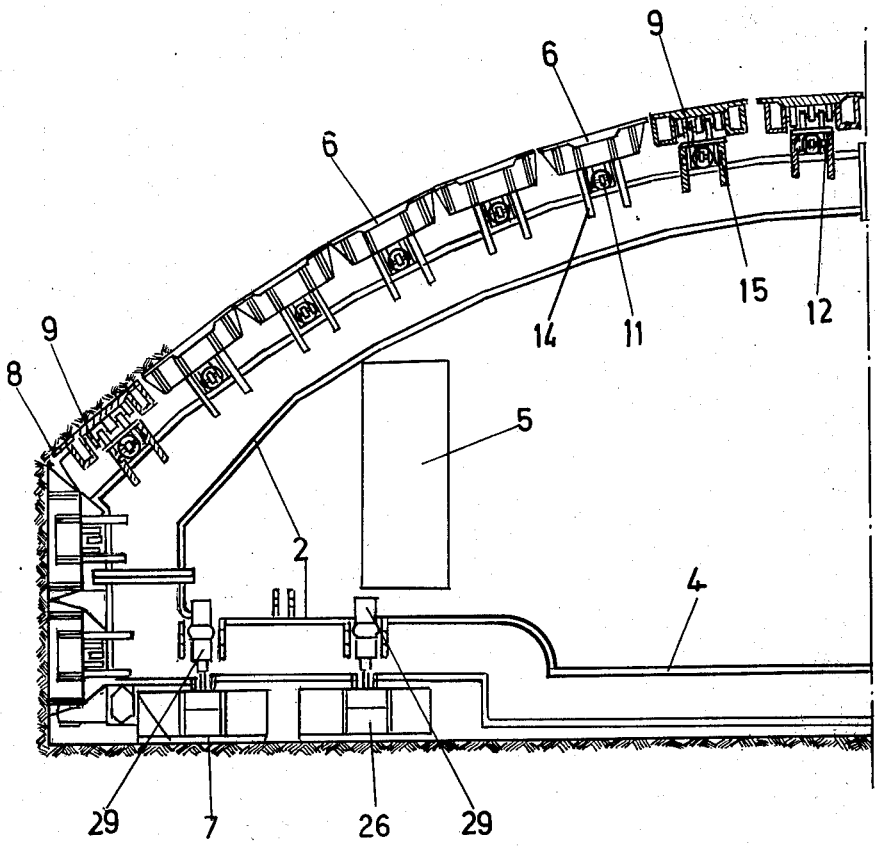
FIG. 1 is a half front view of the machine.

As can be seen in FIGS. 1 and 2, the load-bearing frame of the machine is formed by a forward arch 1 and another rear one 2, parallel as shown in the sketch, and mutually braced by means of intervening members 3 defining a lower platform 4. The control panel is indicated by the numeral 5.

The shores 6 are mounted on the arches 1 and 2 and the whole rig is mounted on skids generally designated by the number 7, located on both sides of the rig beneath a lower frame formed by the arches.

The section of the structure and therefore of the arches 1 and 2 will depend on the dimensions and shape of the tunnel to be dug, its principal function being to withstand and absorb the load that the tunnel walls and roof 8 exert on the shores 6, as well as the thrust of the hydraulic cylinders responsible for moving the rig forward.

As is seen in FIGS. 3 and 5, the shores 6 are supported in front on a freely rotating roller 9 which is mounted on an independent support 10 pivoted on a hyraulic cylinder 11 by means of the corresponding axis 12. At its rear the hydraulic cylinder 11 is pivoted on the axis 13 at the lugs 14 attached to forward arch 1. The lugs 14 each have slots 15 in their facing surfaces inclined upwards between which slots the axis 12 is held by its ends, the slots defining an inclined plane along which the axis 12 moves when cylinder 11 is actuated.

With this arrangement, there is obtained an elastic support by means of which the shores can be moved normally to the forward arch 1, thus varying the section of the machine and constantly maintaining the shore 6 in contact with the tunnel surface 8. In addition, the machine is thus guided in plan and elevation, producing friction forces and suitably distributing the tensions and loads.

The heads 16 of the shores shown in FIG. 4 and positionable by the mobility of the end section 17 of these shores.

In order to avoid lateral displacements of the shores, there are collars 18 mounted on the impulse cylinder 19 which is pivoted at its back end on the rear arch 2 by means of the axis 20 and at its forward end on the shore 6 by means of the pivot 21. The collars 18 are arranged in engagement with the adjacent portions of the shore as shown best in FIG. 1*a*.

The construction of the entire front end is shown also in FIG. 1 where the structure has been sectioned in distinct vertical planes to show clearly the different interconnected elements.

Figure 7:
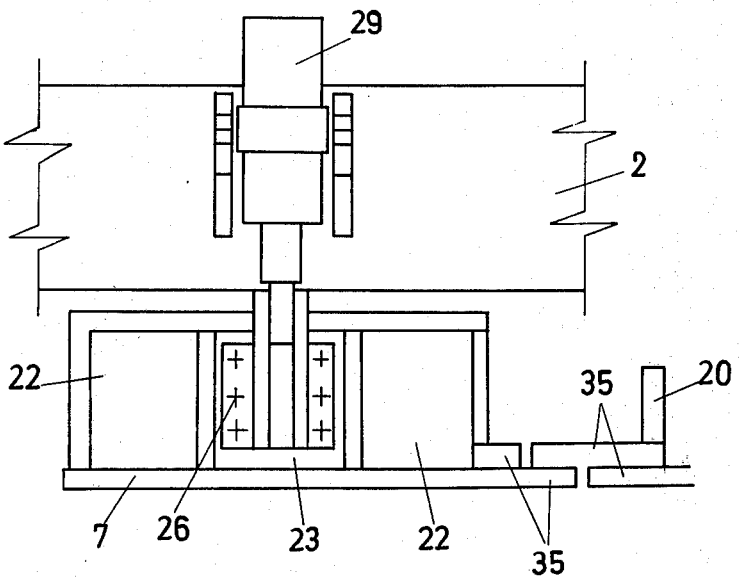
FIG. 7 is a partial rear view of a ski.

The skids 7, as can be seen in FIG. 2 and 7 are divided longitudinally into three parts, two side ones 22 and a central one 23.

Figure 1A:
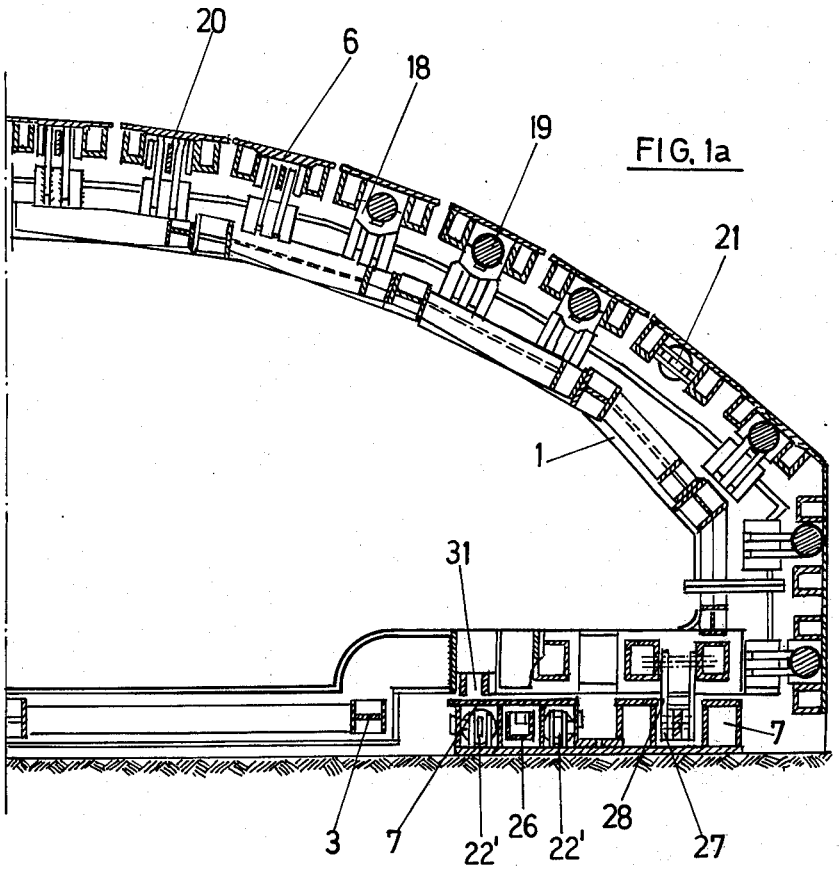
FIG. 1*a* is a half rear view of the machine in partial section in order to show part of the internal mechanisms.

In each of the parts 22 there are located hydraulic cylinders 22′ as shown in FIG. 1*a*, articulated at their back ends to the arch 2 between the lugs 24, while their front ends are connected to the lugs 25 attached to the skids. By the actuation of these cylinders, the skids are moved with respect to the load-bearing structure.

Figure 6:
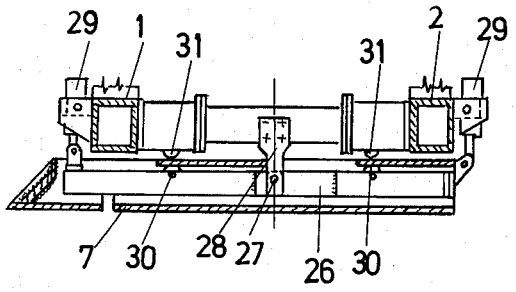
FIG. 6 is a longitudinal section of a skid.

In the central part 23, there is located a guide beam 26 consisting, as can be seen better in FIG. 6, of two portions, one forward and the other behind, of approximately equal lengths. These portions are articulated in common at the axis 27 mounted between the lugs 28 which are attached above to the load-bearing frame. The pieces forming the beam 26 are connected at their free ends to the forward arch 1 and to the rear one 2 by means of the hydraulic cylinders 29. The skids rest on the guide beam 26 by way of freely rotating rollers 30 mounted, one on the forward position and another on the rear position of the two which compose each guide beam.

Figure 9:
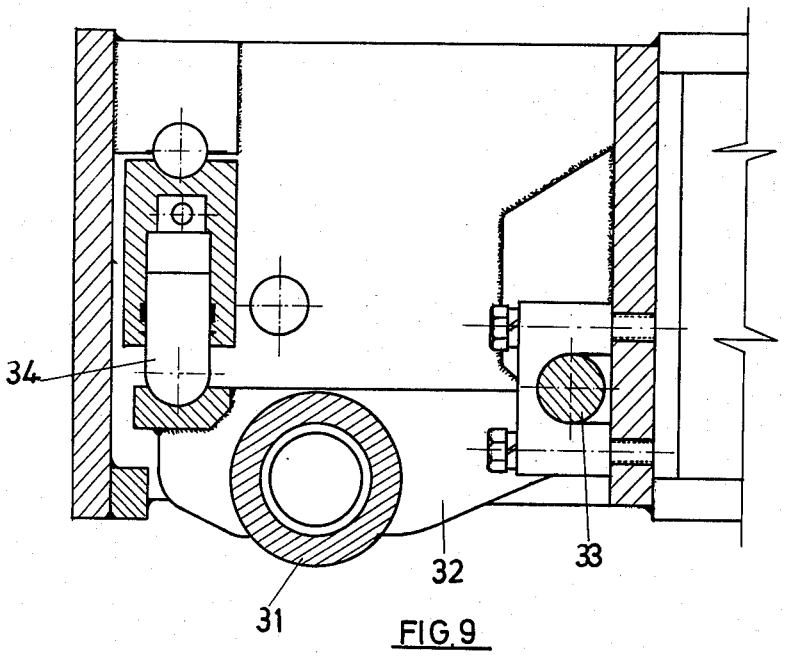
FIG. 9 is a section along the line IX—IX of FIG. 2.

The support of the load-bearing frame on the skids is realized by means of freely rotating rollers 31 which, as can be seen clearly in FIG. 9, are mounted between two parallel lugs 32 pivoted at one of their ends about the axis 33 to the load-bearing frame.

With this arrangement, when the skid 7 changes its position with respect to the frame, the roller 31 goes up or down, rocking about the axis 33, the piston 34 resisting these changes under actuation by a hydraulic circuit with nitrogen accumulators and their associated oil reservoirs. The various circuits can cooperate to counteract the irregularities of the floor on both sides.

In the plan view of FIG. 2, there is also seen the arrangement of the roller 31, piston 34 and lugs 32. On each skid are located four cylinders, two in front and two in back, only one of each being shown in FIG. 2.

Figure 8:
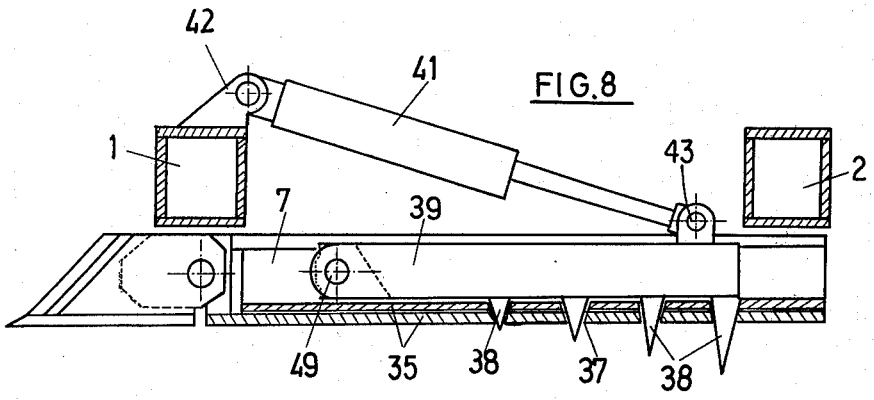
FIG. 8 is a side view of the anchoring beam.

As can be seen in FIGS. 1 and 2, the skids are arranged in pairs and each of them is extended in the direction of the other, as shown in FIG. 7, by a set of wings 35 which overlap. A portion of the wings is provided with openings 37 as shown in FIG. 8, those of the upper wing lining up with those in the lower, to allow passage of the teeth 38 which project from the bottom surface of a beam 39 located in the space left between the two skids. This beam is articulated at its front end with the skids about an axis 49, while its back end is connected in pivoting fashion to the cylinder 41, the forward end of which is articulated with arch 1. As seen in FIG. 8, the teeth 38 increase in length in going from front to rear.

The beam 39 serves to connect each pair of skids as well as to prevent them from slipping backwards by sinking the teeth 38 into the ground. When it is desired to move the skids forward, cylinder 41 is actuated so that the beam 39 rises, turning on the axis 49, retracting the teeth 38 so that they do not hinder the advancement of the skids.

In FIG. 2 are shown the lugs 42 by means of which cylinder 41 is anchored to the forward arch 1, as well as the lugs 43 by which it is anchored to the beam 39.

On the outer side of each skid there are disposed, as shown in FIG. 2, two freely rotating rollers 44 which rest against the corresponding side of the skids and which are mounted in the same way as rollers 31, on rocker arms 45 articulated at one of their ends on the frame by means of axis 46 while at the opposite end, they rest against the cylinders 47, all of this having a configuration identical to that described in connection with FIG. 8. These elastic supports guide the skids 7 horizontally.

With the machine described, when the shoring of a section has been accomplished, all the impulse cylinders, identified by the number 19 and associated with the shores and those of the skids; are retracted, the shores 6 propping up the section which has been dug. In order to proceed to the next section, the impulse cylinders 19 are actuated so that the shores 6 advance, shaping the surface 8 of the tunnel, orienting the machine in plan and elevation according to the adjustment of the position of the portion 17 of the head 16 of the said shores. This advancement of the shores 6 can be performed on all of them simultaneously or by groups according to the type and condition of the tunnel surfaces and all or part of the volume to be dug next can be established before excavating it.

When all of the shores have been repositioned, the skids 7 may then be advanced by the thrust of the associated impulse cylinders until they are in the same position as the said shores 6, then cylinders 19 and the impulse cylinders of the skids being thus fully extended, so that the load-bearing structure, i.e., the arches 1 and 2 and the platform 4, is left behind. In order to being it forward, the impulse cylinders of the shores and skids are caused to retract, drawing the whole frame forward, assuming that the resistance and pressure exerted by the shores and skids, anchored by the teeth 38 prevent them from sliding backwards.

All these movements are controlled in orientation by the various arrangements for support and guidance described.

Obviously, modifications of the details can be introduced without going beyond the bounds of the present invention.

It is claimed:

1. Improvements in continuous shoring machines for the construction of tunnels comprising in combination, a load-bearing structure for transverse supporting engagement with the tunnel walls, a plurality of supporting skids arranged in pairs in side-by-side relationship for supporting said load-bearing structure, shores mounted on said structure for shaping and shoring up the tunnel wall, elastic support means for connecting said structure with said shores, elastic support means for connecting said structure with said skids for guiding said skids for vertical and horizontal movement, each pair of skids having longitudinal wings extending laterally from the bottoms of their opposed faces and having portions arranged in overlapping relationship, said portions being provided with matching holes, a beam having a bottom surface located in the space between each pair of skids, a plurality of teeth on said beam bottom surface arranged to be accommodated within said holes, said teeth being long enough to serve as anchoring elements on the tunnel floor when projecting through said holes to facilitate the advance of the frame, said beam being pivoted at its front end on one pair of skids about a transverse axis, said beam having a back end and means including a hydraulic cylinder for connecting said beam to the load-bearing structure and said hydraulic cylinder being arranged to retract said teeth upon raising of said beam.

2. Improvements as set forth in claim 1 wherein the elastic support means which connect the load-bearing structure with the skids comprise freely rotating rollers arranged on a horizontal axis, a pair of lugs pivotally connected at corresponding ends on said load-bearing frame, said rollers being disposed on the top of said skids between said pair of lugs, a hydraulic cylinder, the other end of said lugs arranged in supporting relationship with said load-bearing frame through said hydraulic cylinder thereby permitting the variation of the inclination of the skids in the vertical plane with respect to the frame and with it the height of the frame at its front or rear to facilitate the orientation of the machine.

3. Improvements as set forth in claim 1 wherein said elastic support means between said load-bearing frame and said shores include a freely rotating roller for supporting the forward end of said shore, a hydraulic cylinder, a pair of lugs attached to said frame, an independent support articulated with the front end of said hydraulic cylinder, said hydraulic cylinder rotatably connected to the frame for rotation about a transverse axis, the axis of articulation of said independent support with said hydraulic cylinder being mounted between said pair of lugs attached to the frame, a plurality of slots in the facing surfaces of the said lugs which define an upward inclined plane, said independent support being arranged to slide along said slots to permit the end section of the shores to be forced outwards, an impulse cylinder for connecting each shore to said frame, a plurality of collars attached to said shore, said impulse cylinder being mounted in said collars and pivotally connected at its forward end to said shore and at its back end to said frame.

4. Improvements as set forth in claim 1, including a beam for guiding the said skids in the vertical directions, said beam being deposed within each skid and including two pieces of about equal length and pivoted on one another about a horizontal axis, a pair of lugs attached to said frame, said horizontal axis being arranged between said lugs, means including a pivotally mounted hydraulic cylinder for pivotally connecting the free ends of the said pieces to the front and rear of said frame, a roller associated with each piece of said beam at its top freely rotatable about a horizontal axis and arranged in supporting relationship with said skid.

5. Improvements as set forth in claim 1 including a pair of rollers arranged for free rotation about a vertical axis for guiding said skids horizontally, a pair of rocker arms, said rollers being disposed on said rocker arms against the sides of said skids said rocker arms being articulated at one of their ends about a vertical axis on said frame, a horizontally extending hydraulic cylinder, the other ends of said rocker arms being supported on said frame through said hydraulic cylinder to permit variation in the inclination of the skids in a horizontal plane with respect to the frame and with it the orientation of the rig.

* * * * *